US012233461B2

(12) United States Patent
Bales et al.

(10) Patent No.: US 12,233,461 B2
(45) Date of Patent: Feb. 25, 2025

(54) POWDER METALLURGY METHOD USING A FOUR-WALL CYLINDRICAL CANISTER

(71) Applicant: United Technologies Corporation, Farmington, CT (US)

(72) Inventors: Daniel A. Bales, Avon, CT (US); Andrew L. Haynes, Glastonbury, CT (US)

(73) Assignee: RTX CORPORATION, Farmington, CT (US)

( * ) Notice: Subject to any disclaimer, the term of this patent is extended or adjusted under 35 U.S.C. 154(b) by 1101 days.

(21) Appl. No.: 16/590,644

(22) Filed: Oct. 2, 2019

(65) Prior Publication Data

US 2020/0122233 A1 Apr. 23, 2020

Related U.S. Application Data

(60) Provisional application No. 62/747,840, filed on Oct. 19, 2018.

(51) Int. Cl.
*B22F 3/15* (2006.01)

(52) U.S. Cl.
CPC ..... *B22F 3/15* (2013.01); *B22F 2003/153* (2013.01)

(58) Field of Classification Search
CPC ..... B22F 3/15; B22F 2003/153; B22F 3/162
See application file for complete search history.

(56) References Cited

U.S. PATENT DOCUMENTS

| | | | |
|---|---|---|---|
| 5,435,965 | A | 7/1995 | Mashima et al. |
| 5,482,672 | A | 1/1996 | Friedman et al. |
| 5,540,882 | A | 7/1996 | Billgren |
| 7,407,622 | B2 | 8/2008 | Voice et al. |
| 8,303,289 | B2 | 11/2012 | Goller et al. |
| 8,409,497 | B2 | 4/2013 | Pandey |
| 8,490,281 | B2 | 7/2013 | Voice |
| 9,089,896 | B2 | 7/2015 | Goller et al. |
| 9,327,349 | B2 | 5/2016 | Lipetzky et al. |
| 9,701,584 | B2 | 7/2017 | Care et al. |
| 2005/0214156 | A1 | 9/2005 | Troitski et al. |

(Continued)

FOREIGN PATENT DOCUMENTS

| | | |
|---|---|---|
| CN | 102806353 | 12/2012 |
| CN | 105728708 | 7/2016 |

(Continued)

OTHER PUBLICATIONS

European Search Report for European Patent Application No. 19204137.4 completed Jan. 31, 2020.

*Primary Examiner* — Ricardo D Morales
(74) *Attorney, Agent, or Firm* — Carlson, Gaskey & Olds, P.C.

(57) ABSTRACT

A powder metallurgy method includes a canister that has canister walls that define a hermetic chamber that circumscribes an open central region. A metallic alloy powder is inserted into the hermetic chamber, followed by evacuating the hermetic chamber. The canister with the metallic alloy powder is then subjected to a hot isostatic pressing process that includes heating the canister and the metallic alloy powder and applying isostatic pressure to the canister. The heating and the isostatic pressure causes fusion and consolidation of the metallic alloy powder to form a solid workpiece. The canister is then removed from the solid workpiece.

15 Claims, 3 Drawing Sheets

(56) References Cited

U.S. PATENT DOCUMENTS

| | | | | |
|---|---|---|---|---|
| 2009/0226338 | A1 | 9/2009 | Troitski et al. | |
| 2009/0269605 | A1* | 10/2009 | Warke | B21C 33/004 428/550 |
| 2011/0142709 | A1* | 6/2011 | Voice | B22F 3/12 419/28 |
| 2016/0303657 | A1 | 10/2016 | Bochiechio et al. | |
| 2018/0010216 | A1 | 1/2018 | Vo et al. | |
| 2018/0200799 | A1 | 7/2018 | Mulcaire | |

FOREIGN PATENT DOCUMENTS

| | | |
|---|---|---|
| DE | 19526576 | 2/1996 |
| DE | 102011080225 | 2/2013 |
| EP | 1779946 | 5/2007 |
| EP | 2364800 | 9/2011 |
| EP | 2679323 | 1/2014 |
| EP | 3072611 | 9/2016 |
| EP | 3106248 | 12/2016 |
| WO | 2006008197 | 1/2006 |
| WO | 2011041141 | 4/2011 |
| WO | 2014115379 | 7/2014 |
| WO | 2015090831 | 6/2015 |
| WO | 2018091969 | 5/2018 |

* cited by examiner

POWDER METALLURGY METHOD USING A FOUR-WALL CYLINDRICAL CANISTER

CROSS-REFERENCE TO RELATED APPLICATION

This application claims priority to U.S. Provisional Application No. 62/747,840 filed Oct. 19, 2018.

BACKGROUND

Powder metallurgy is known and used for producing many different types of components, such as gas turbine engine components. Powder metallurgy processing can typically include placing a metallic powder into a vessel, heating the vessel to heat and sinter the powder to produce a sintered workpiece, and then removing the vessel from the sintered workpiece to produce a billet. The billet can then be further processed by cutting, machining, forging and the like to produce end-use components.

SUMMARY

A powder metallurgy method according to an example of the present disclosure includes a canister that has canister walls that define a hermetic chamber that circumscribes an open central region. A metallic alloy powder is inserted into the hermetic chamber, followed by evacuating the hermetic chamber, subjecting the canister with the metallic alloy powder in the hermetic chamber to a hot isostatic pressing process that includes heating the canister and the metallic alloy powder and applying isostatic pressure to the canister. The heating and the isostatic pressure cause fusion and consolidation of the metallic alloy powder to form a solid workpiece. The canister is then removed from the solid workpiece.

In a further embodiment of any of the foregoing embodiments, the canister includes a first wall, a second wall spaced inwards from the first wall such that there is an annular space there between, a first end wall joining the first wall and the second wall, and a second end wall spaced from the first end wall and joining the first wall and the second wall. The first wall, the second wall, the first end wall, and the second end wall define there between the hermetic chamber.

In a further embodiment of any of the foregoing embodiments, the first wall and the second wall are concentric.

In a further embodiment of any of the foregoing embodiments, the central region is a through-hole that opens at both the first end wall and the second end wall.

In a further embodiment of any of the foregoing embodiments, the canister includes a first cylindrical wall, a second cylindrical wall spaced inwards from the first cylindrical wall such that there is an annular space there between. A first end wall join the first cylindrical wall and the second cylindrical wall, and a second end wall spaced from the first end wall and join the first cylindrical wall and the second cylindrical wall. The first cylindrical wall, the second cylindrical wall, the first end wall, and the second end wall define there between a hermetic chamber.

In a further embodiment of any of the foregoing embodiments, the port is through the first end wall.

In a further embodiment of any of the foregoing embodiments, the first cylindrical wall is of a first thickness and the second cylindrical wall is of a second thickness that is equal to the first thickness.

In a further embodiment of any of the foregoing embodiments, the canister includes a port to access the hermetic chamber, and the inserting of the powder into the hermetic chamber is through the port, followed by sealing off the port.

A further embodiment of any of the foregoing embodiments includes, after the removing of the canister, forming one or more end-use components from the solid workpiece.

A further embodiment of any of the foregoing embodiments includes forming the metallic alloy powder.

A powder metallurgy method according to an example of the present disclosure includes a canister that has canister walls that define a hermetic chamber that circumscribes an open central region. The canister has a port to access the hermetic chamber, forming a metallic alloy powder. The metallic alloy powder is inserted through the port into the hermetic chamber, followed by evacuating the hermetic chamber and sealing off the port, subjecting the canister with the metallic alloy powder in the hermetic chamber to a hot isostatic pressing process that includes heating the canister and the metallic alloy powder and applying isostatic pressure to the canister. The heating and the isostatic pressure cause fusion and consolidation of the metallic alloy powder to form a solid workpiece. The canister is then removed from the solid workpiece, and form one or more end-use components from the solid workpiece.

In a further embodiment of any of the foregoing embodiments, the canister includes a first cylindrical wall, a second cylindrical wall spaced inwards from the first cylindrical wall such that there is an annular space there between, a first end wall joining the first cylindrical wall and the second cylindrical wall, and a second end wall spaced from the first end wall and joining the first cylindrical wall and the second cylindrical wall. The first cylindrical wall, the second cylindrical wall, the first end wall, and the second end wall define there between the hermetic chamber.

In a further embodiment of any of the foregoing embodiments, the first cylindrical wall is of a first thickness and the second cylindrical wall is of a second thickness that is equal to the first thickness.

In a further embodiment of any of the foregoing embodiments, the port is through the first end wall.

In a further embodiment of any of the foregoing embodiments, the first cylindrical wall and the second cylindrical wall are concentric.

A powder metallurgy method according to an example of the present disclosure includes a canister that has an annular hermetic chamber. A metallic alloy powder is inserted into the annular hermetic chamber, followed by evacuating the annular hermetic chamber and sealing off the port, and subjecting the canister with the metallic alloy powder in the annular hermetic chamber to a hot isostatic pressing process that includes heating the canister and the metallic alloy powder and applying isostatic pressure to the canister. The heating and the isostatic pressure cause fusion and consolidation of the metallic alloy powder to form a solid annular workpiece.

In a further embodiment of any of the foregoing embodiments, the annular hermetic chamber defines a chamber height and a chamber outer diameter, and the chamber height is greater than the chamber outer diameter.

An article according to an example of the present disclosure includes a canister that has an annular hermetic chamber and a metallic alloy powder in the annular hermetic chamber. The canister is configured to deform when subjected to a hot isostatic pressing process that includes heating the canister and the metallic alloy powder and applying isostatic pressure to the canister, such that the heating and the isostatic pressure cause fusion and consolidation of the metallic alloy powder.

BRIEF DESCRIPTION OF THE DRAWINGS

The various features and advantages of the present disclosure will become apparent to those skilled in the art from the following detailed description. The drawings that accompany the detailed description can be briefly described as follows.

DETAILED DESCRIPTION

Figure 1A:
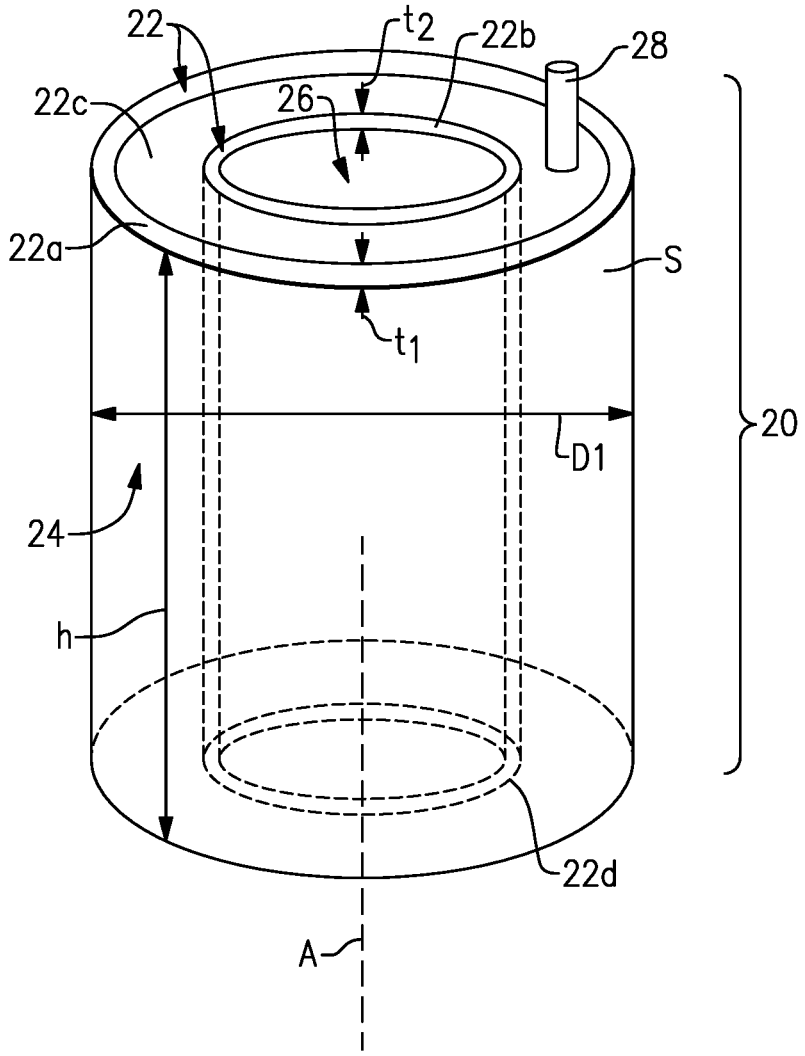
FIG. 1A illustrates an example canister for a powder metallurgy process.

FIG. 1A schematically illustrates a canister 20 for use in a powder metallurgy method, which will also be described further below. The canister 20 is adapted to permit a metallic alloy powder to be subjected to a hot isostatic process, which uniformly consolidates and sinters the powder to thereby provide enhanced properties in end-use components.

The canister 20 generally has canister walls 22 that define a hermetic chamber 24 in which a metallic alloy powder is to be placed. For instance, the walls 22 may be metal walls that are welded or otherwise bonded together in an airtight manner The walls 22, and thus also the hermetic chamber 24, circumscribe an open central region 26.

Figure 1B:
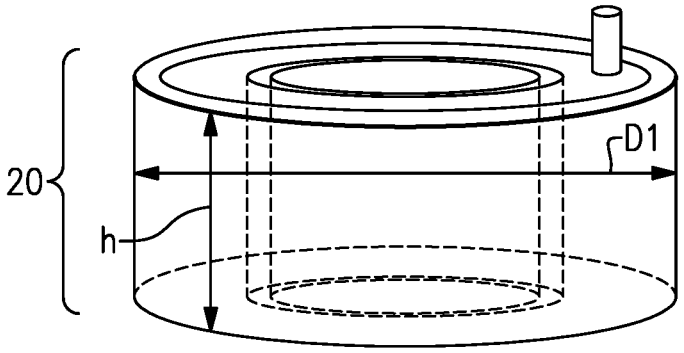
FIG. 1B illustrates another example canister that is similar to, but shorter than, the canister in FIG. 1A.

The walls 22 of the canister 20 include a first wall 22*a*, a second wall 22*b* spaced inwards from the first wall 22*a* such that there is an annular space (S) there between. The second wall 22*b* also defines the sides of the central region 26. A first end wall 22*c* joins the first wall 22*a* and the second wall 22*b*, and a second end 22*d* wall is spaced from the first end wall 22*c* and joins the first wall 22*a* and the second wall 22*b*. The central region 26 as shown is a through-hole that opens at both the first end wall 22*c* and the second end wall 22*d*. In this example, the first wall 22*a*, the second wall 22*b*, the first end wall 22*c*, and the second end 22*d* wall define there between the hermetic chamber 24. The hermetic chamber 24 circumscribes the central region 26 and thus has an annular shape The hermetic chamber 24 defines a chamber height (h) and a chamber outer diameter (D1). In this example, the chamber height (h) is greater than the chamber outer diameter (D1). FIG. 1B shows a modified version of the canister 20 in which the chamber height (h) is less than the chamber outer diameter (D1), which may be useful for forming near net-shape components or even end-use components.

Referring again to FIG. 1A, the canister 20 also includes a port 28 that provides access to the hermetic chamber 26. For instance, the port 28 is through the first end wall 22*c*.

In the illustrated example, the canister 20 is cylindrical and the first and second walls 22*a*/22*b* are thus cylindrical and the end walls 22*c*/22*d* are circular or ovular. As will be appreciated, the canister 20 could have a variety of different cylindrical shapes, such as right cylinder, oblique cylinder, or even a truncated cylinder, any of which could be either circle or oval in cross-section. It also shall be appreciated that rather than an open-center cylinder geometry the canister 20 could have an open-center prism geometry, such as but not limited to regular prism, irregular prism, oblique prism, or even truncated prism. At least for the cases of cylinders and regular prisms, the first wall 22*a* and the second wall 22*b* are concentric about a center axis A, and for non-oblique shapes the end walls 22*c*/22*d* are also concentric about the axis A.

In this example, the first wall 22*a* is of a first thickness t1 and the second wall 22*b* is of a second thickness t2 that is equal to the first thickness t1. The equal thicknesses t1 and t2 facilitate uniform application of pressure to the metallic alloy powder in the later-described powder metallurgy process.

Figure 2:
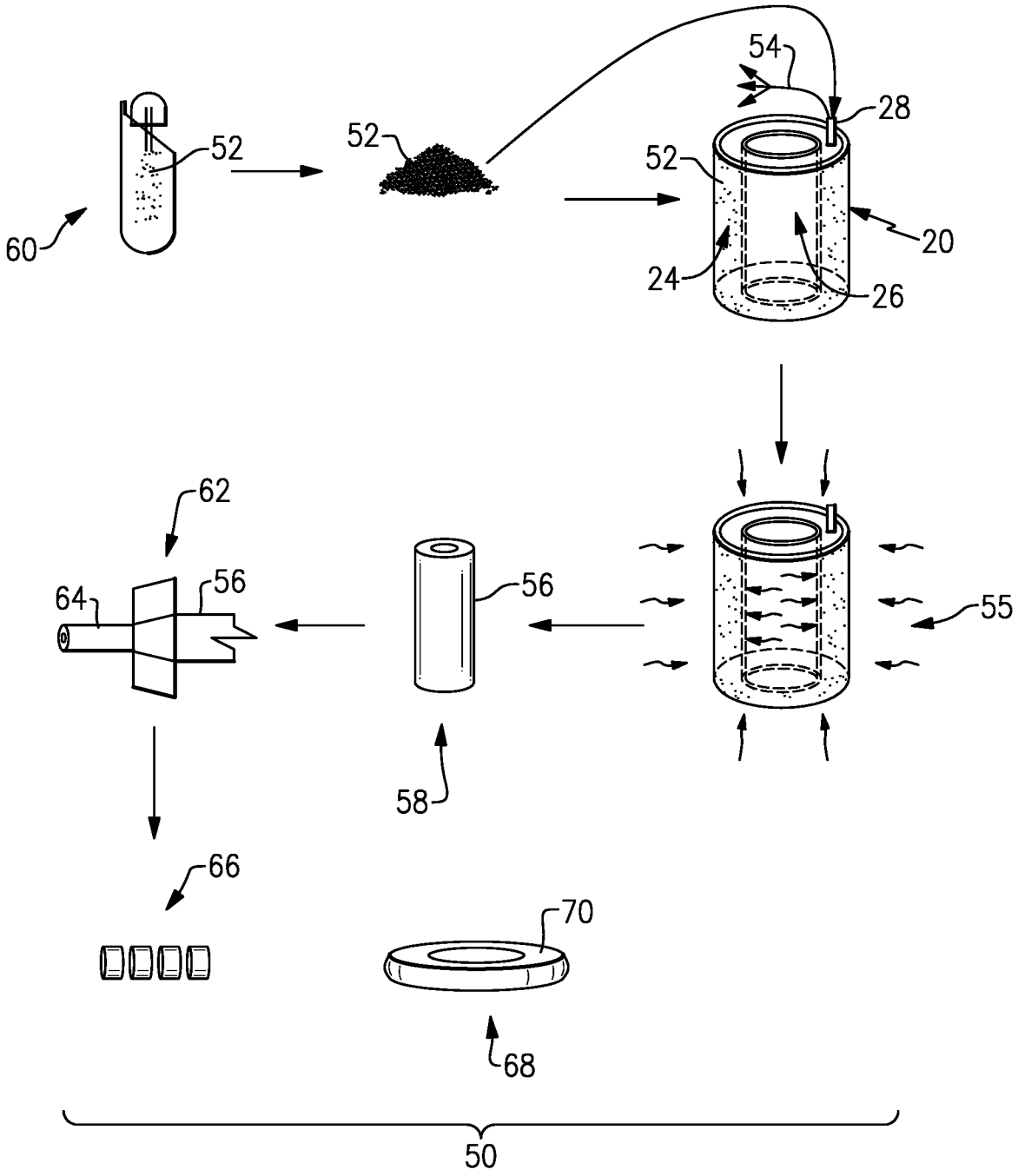
FIG. 2 illustrates an example powder metallurgy method.

The canister 20 is used in a powder metallurgy method 50 depicted in FIG. 2. The method 50 includes inserting a metallic alloy powder 52 into the hermetic chamber 24 of the canister 20. For example, the powder 52 is inserted through the port 28 of the canister 20. The powder 52 may be any powder desired for an end-use components, but superalloy powder, such as nickel or cobalt alloys, are useful for gas turbine engine components.

The hermetic chamber 20 is then evacuated, as represented at 54. As an example, a pump may be used to draw air or other gases out of the hermetic chamber 24. The evacuation process may include flushing the hermetic chamber 24 with one or more inert gases, such as argon, helium, or mixtures thereof. The port 28 may subsequently be sealed off, such as by welding or the like.

The canister 20 with the metallic alloy powder 52 is then subjected at 55 to a hot isostatic pressing ("HIP") process. The HIP process includes heating the canister 20 and the metallic alloy powder 52 and applying isostatic pressure to the canister 20. The heating causes sintering and fusion of the powder 52, while the pressure deforms the canister 20 and thereby compresses the powder 52 to consolidate the powder as it fuses. The time, temperature, and pressure used may be varied in accordance with the type of powder 52. The fusion and consolidation of the powder 52 forms a solid workpiece 56. For example, the solid workpiece 56 is a thick-walled structure that has a thickness from the inner diameter surface to the outer diameter surface of at least 100 millimeters, and most typically no greater than about 350 millimeters.

The open central region 26 of the canister 20 permits heat and isostatic pressure to be applied not only to the outer sides of the hermetic chamber 24 but also from the inner side. The powder 52 is thus consolidated more uniformly. Moreover, since the central region 26 of the canister is open, the workpiece 56 has an open center region. For disks and other components that have bores of open center regions, there is thus no need to cut bores or open center regions as there would be with a closed geometry. This, in turn, reduces waste or rework of the metallic alloy.

For instance, as shown at 58, the canister 20 is subsequently removed from the solid workpiece 56. As an example, the canister 20 can be removed by machining The powder metallurgy method 50 is not limited to the above steps or actions. For example, as also shown at 60 in FIG. 2, the method 50 may additionally include forming the powder 52. For instance, the forming may include atomization of the molten alloy. The powder 52 nominally has uniform dispersion of alloying elements, which facilitates producing a uniform dispersion of elements in the end-use component.

The method 50 may also include extruding the workpiece 56, as indicated at 62. For instance, the workpiece 56 is pushed through a die having an internal mandrel that reduces the cross-section of the workpiece 56 to produce a hollow, thermally mechanically worked billet 64. As shown at 66, the billet 64 may then be cut into multiple pieces, which may also be known as stocks, blanks, mults, or slugs that are used as inputs into further processes. Moreover, since the central region of the workpiece 56, and thus also the billet 64, is open, there may be less friction and thus less cutting resistance, which facilitates more efficient cutting processes. As an example, the stocks, blanks, mults, or slugs may be forged, as indicated at 68, to produce one or more end-use components 70 (e.g., rotor disks). Similarly, the open central region of the stocks, blanks, mults, or slugs may also facilitate more efficient forging by enabling working both from the outer sides and inner sides of the annular shape. As will be appreciated, depending on the shape of the workpiece 56, the extruding and/or cutting may not be necessary and the workpiece 56 may be directly forged at 68 after removal of the canister 20 at 58.

Figure 3:
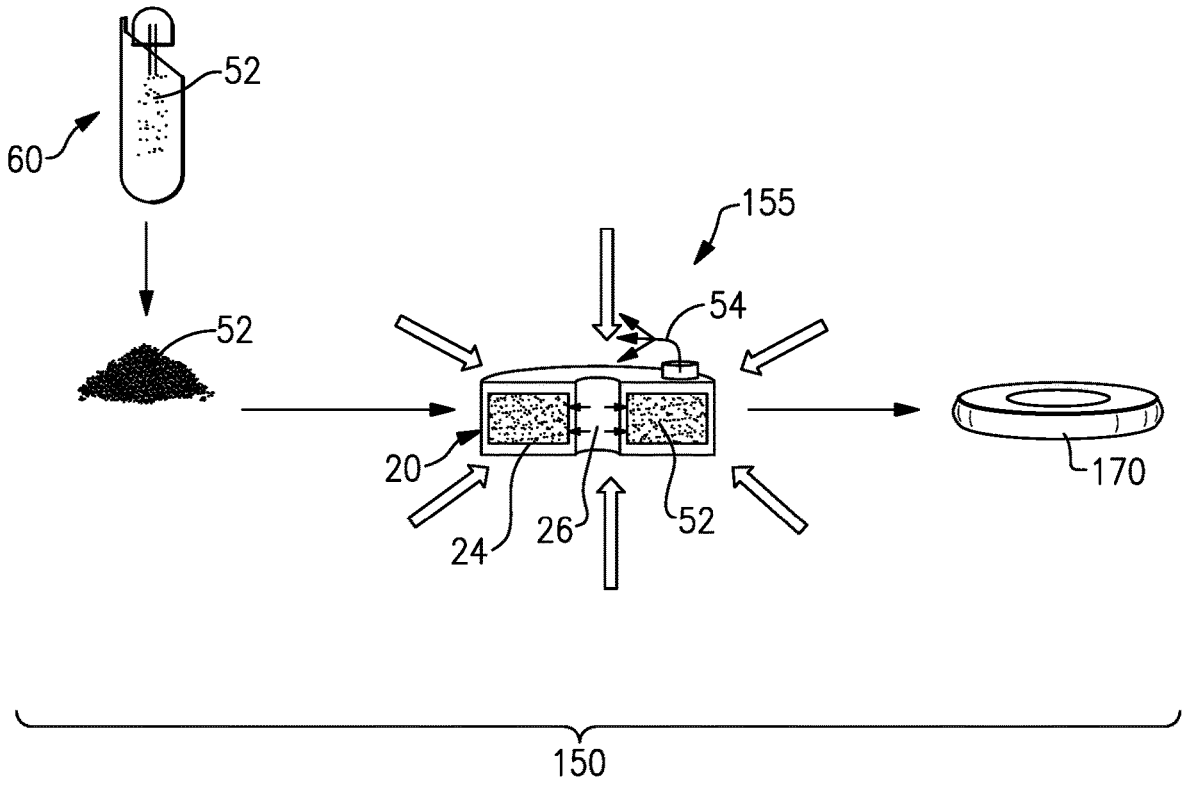
FIG. 3 depicts another example of a powder metallurgy method.

In another alternative shown in FIG. 3, the method 150 is similar to the method 50 but excludes the extruding, cutting, and forging. In this example, the canister 20 with the powder 52 is subjected at 155 to the HIP process as described above. However, rather than forming the solid article workpiece 56 as an intermediate workpiece, the end-use component 170 is formed directly from the HIP process. Such a direct HIP process may be employed, for example, in applications where components are not life limited.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from this disclosure. The scope of legal protection given to this disclosure can only be determined by studying the following claims.

What is claimed is:

1. A powder metallurgy method comprising:

a canister that has canister walls that define a hermetic chamber that circumscribes an open central region, the canister including a first, exterior wall, a second, interior wall spaced inwards from the first wall such that there is an annular space there between, a first end wall joining the first wall and the second wall, and a second end wall spaced from the first end wall and joining the first wall and the second wall, the first wall, the second wall, the first end wall, and the second end wall bounding there between the hermetic chamber;

inserting a metallic alloy powder into the hermetic chamber, followed by evacuating the hermetic chamber;

subjecting the canister with the metallic alloy powder in the hermetic chamber to a hot isostatic pressing process that includes heating the canister and the metallic alloy powder and applying isostatic pressure to the first wall and through the open central region to the second wall of the canister, the heating and the isostatic pressure causing inward deformation of the first wall and outward deformation of the second wall to compress the metallic alloy powder as the metallic alloy powder fuses and consolidates and thereby forms a solid workpiece; and removing the canister from the solid workpiece.

2. The method as recited in claim 1, wherein the first wall and the second wall are concentric.

3. The method as recited in claim 1, wherein the central region is a through-hole that opens at both the first end wall and the second end wall.

4. The method as recited in claim 1, wherein the first wall and the second wall are cylindrical.

5. The method as recited in claim 4, wherein there is a port is through the first end wall.

6. The method as recited in claim 1, wherein the first wall is of a first thickness and the second wall is of a second thickness that is equal to the first thickness.

7. The method as recited in claim 1, wherein the canister includes a port to access the hermetic chamber, and the inserting of the powder into the hermetic chamber is through the port, followed by sealing off the port.

8. The method as recited in claim 1, further comprising, after the removing of the canister, forming one or more end-use components from the solid workpiece.

9. The method as recited in claim 1, further comprising forming the metallic alloy powder.

10. A powder metallurgy method comprising:

a canister that has canister walls that define a hermetic chamber that circumscribes an open central region, the canister including a first, exterior wall, a second, interior wall spaced inwards from the first wall such that there is an annular space there between, a first end wall joining the first wall and the second wall, and a second end wall spaced from the first end wall and joining the first wall and the second wall, the first wall, the second wall, the first end wall, and the second end wall bounding there between the hermetic chamber, and the canister having a port to access the hermetic chamber;

inserting the metallic alloy powder through the port into the hermetic chamber, followed by evacuating the hermetic chamber and sealing off the port;

subjecting the canister with the metallic alloy powder in the hermetic chamber to a hot isostatic pressing process that includes heating the canister and the metallic alloy powder and applying isostatic pressure to the first wall and through the open central region to the second wall of the canister, the heating and the isostatic pressure causing inward deformation of the first wall and outward deformation of the second wall to compress the metallic alloy powder as the metallic alloy powder fuses and consolidates and thereby forms a solid workpiece;

removing the canister from the solid workpiece; and forming one or more end-use components from the solid workpiece.

11. The method as recited in claim 10, wherein the first wall and the second wall are cylindrical.

12. The method as recited in claim 11, wherein the first wall is of a first thickness and the second wall is of a second thickness that is equal to the first thickness.

13. The method as recited in claim 12, wherein the port is through the first end wall.

14. The method as recited in claim 13, wherein the first wall and the second wall are concentric.

15. The method as recited in claim 1, wherein the hermetic chamber has a chamber height and a chamber diameter, and the chamber height is less than the chamber diameter.

* * * * *